US007534274B2

(12) United States Patent
Lee

(10) Patent No.: US 7,534,274 B2
(45) Date of Patent: May 19, 2009

(54) VEHICLE FUEL COMPOSITION

(76) Inventor: Mao-Sheng Lee, 11 Fl., No. 201, Nanking East Road, Sec. 3, Taipei (TW)

( * ) Notice: Subject to any disclaimer, the term of this patent is extended or adjusted under 35 U.S.C. 154(b) by 893 days.

(21) Appl. No.: 11/051,928

(22) Filed: Feb. 7, 2005

(65) Prior Publication Data

US 2006/0174538 A1 Aug. 10, 2006

(51) Int. Cl.
*C10L 1/22* (2006.01)
*C10L 1/18* (2006.01)

(52) U.S. Cl. ..... 44/434; 44/412; 44/436

(58) Field of Classification Search ..... 44/412, 44/434, 436

See application file for complete search history.

(56) References Cited

U.S. PATENT DOCUMENTS 4,638,089 A * 1/1987 Hisamoto et al. ..... 564/292
5,401,280 A * 3/1995 Kaneko et al. ..... 44/449

FOREIGN PATENT DOCUMENTS

JP 62100592 A * 2/1987

* cited by examiner

*Primary Examiner*—Glenn Caldarola
*Assistant Examiner*—Jim Goloboy

(57) ABSTRACT

A vehicle fuel composition comprises: a light or low-carbon hydrocarbon or pentane fraction; a non-lead anti-knocking agent including methyl tert-butyl ether, tert-amyl methyl ether, anhydrous methanol and anhydrous ethanol; a fluorocarbon cation surfactant and/or a fluorocarbon non-ionic surfactant; which are thoroughly blended to obtain a motor fuel having a research octane number of more than ninety for enhancing anti-knocking property and also for minimizing carbon accumulation in a combustion engine system.

2 Claims, No Drawings

VEHICLE FUEL COMPOSITION

BACKGROUND OF THE INVENTION

U.S. Pat. No. 4,468,233 disclosed a motor fuel containing alkyl tert-butyl ethers for increasing the octane number and decreasing the proportion of pollutants in the exhaust gas. Even this prior art can be prepared lead-free for decreasing pollutants in the exhaust, it however does not show any benefit to reduce the carbon deposit in an internal combustion system. The carbon as accumulated in the combustion system may lower the fuel combustion efficiency and engine efficiency and may also shorten the engine life.

The present inventor has found the drawbacks of the prior art and invented the present fuel composition having high octane number for enhancing anti-knocking property and also for minimizing the carbon deposit in a combustion system.

SUMMARY OF THE INVENTION

The object of the present invention is to provide a vehicle fuel composition comprising: a light or low-carbon hydrocarbon or pentane fraction; a non-lead anti-knocking agent including methyl tert-butyl ether, tert-amyl methyl ether, anhydrous methanol and anhydrous ethanol; a fluorocarbon cation surfactant and/or a fluorocarbon non-ionic surfactant; which are thoroughly blended to obtain a motor fuel having a research octane number of more than ninety for enhancing anti-knocking property and also for minimizing carbon accumulation in a combustion engine system.

DETAILED DESCRIPTION

For obtaining the vehicle fuel composition of the present invention, a preparation method is provided, which comprises the steps of:

A. collecting the light or low-carbon hydrocarbon fraction including pentane fraction from catalytic cracking by-products of an oil refinery or from a condensed gas oil of a natural gas plant;

B. adding non-lead anti-knocking agent into the light hydrocarbon fraction of 1~15 parts (by weight) based on 100 parts (by weight) of the hydrocarbon fraction;

C. further adding fluorocarbon cation surfactant of 0.001~0.04 parts (by weight);

D. with or without adding non-ionic fluorocarbon surfactant of 0.001~0.04 parts (by weight); and E. well blending of the hydrocarbon fraction with the anti-knocking agent and surfactants for obtaining a vehicle fuel composition having a research octane number (RON) of more than 90.

The non-lead anti-knocking agent may be selected from the group consisting of methyl tert-butyl ether, tert-amyl methyl ether, anhydrous methanol and anhydrous ethanol.

The fluorocarbon cation surfactant may be selected from the group consisting of a quaternary ammonium salt of fluorine-containing alkylamine, a quaternary ammonium salt of perfluoro alkylamide, and fluoroalkylamine salt.

The non-ionic fluorocarbon surfactant may be selected from fluorine-containing alkylether alcohol and the others.

The anhydrous methanol as used in the present invention may be a methanol of 99.7% purity, which may be produced from coal and further processed by dehydration.

The anhydrous ethanol may be obtained from biomass energy or other related sources.

The anhydrous methanol or anhydrous ethanol as added in this invention may be 1~15 parts (by weight) based on 100 parts (by weight) of the light hydrocarbon fraction, namely the pentane fraction.

The percentage of the anhydrous methanol or anhydrous ethanol as added in this invention may be optionally adjusted depending upon the desired octane number (RON).

The above-mentioned methyl tert-butyl ether, tert-amyl ether, anhydrous methanol or anhydrous ethanol are provided to substitute the conventional anti-knocking agent of tetraethyl lead which is a poisonous pollutant hazardous to the environment.

So, the ingredients as used in this invention may be beneficial for environmental protection.

The cation surfactants as used in the present invention may be selected from anyone of the following salts:

1. Quaternary ammonium salt of fluorine-containing alkyl amine having a formula of:

$$(CF_3)_2CF(CF_2)_6CH_2CH(OH)CH_2N^+(CH_3)_3I^-;$$

2. Quaternary ammonium salt of perfluoro alkyl amide having a formula of:

$$C_7F_{15}CONH(CH_2)_3N^+(CH_3)_3I^-; \text{ and}$$

3. Fluoroalkyl amine salt with formula of:

$$[F(CF_2)_3CH(OH)CH_2]_2NCH_2CH_2NH_2.H_2SO_4.$$

The non-ionic fluorocarbon surfactant of fluorine-containing alkylether alcohol includes the following formulas:

$$C_8F_{17}C_2H_4O[CH_2CH(CH_2OH)O]nH \ (n=1.7) \text{ and}$$

$$C_8F_{17}C_2H_4SO_2NH[CH_2CH(CH_2OH)O]nH \ (n=1.7).$$

The content of the non-ionic fluorocarbon surfactant may range from 0.001~0.01 parts (by weight), and preferably being 0.005 parts (by weight), based on 100 parts (by weight) of the light hydrocarbon (or pentane) fraction.

By adding of the fluorocarbon cation surfactant of quaternary ammonium salt or fluoroalkyl amine salt; or by further adding of the non-ionic fluorocarbon surfactant into the fuel of light hydrocarbon or pentane fraction, it may greatly inhibit the volatility of the hydrocarbon fuel and may clean the combustion system and exhaust system to minimize the carbon deposit or accumulation in the combustion and exhaust system, thereby enhancing a well environmental protection and prolonging the service life of a combustion engine or machine.

The present invention may be further described in detail with reference to the examples as below-mentioned:

EXAMPLE 1

A pentane fraction as obtained from a refinery has an octane number (RON) of 78, which is well blended with the additives to form a vehicle fuel composition comprising:

| | |
|---|---|
| a. Pentane fraction | 100 parts (by weight) |
| b. Methyl tert-butyl ether | 6 parts (by weight) |
| c. Quaternary ammonium salt of fluorine-containing alkyl amine with formula of: $(CF_3)_2CF(CF_2)_6CH_2CH(OH)CH_2N^+(CH_3)_3I^-$ | 0.01 parts (by weight) |

The fuel composition thus obtained has an octane number (RON) of 93, which has been increased from the original pentane fraction having RON of 78.

The above-mentioned quaternary ammonium salt of fluorine-containing alkyl amine (item c) may be substituted with quaternary ammonium salt of perfluoro alkylamide, or substituted with fluoroalkyl amine salt.

EXAMPLE 2

A pentane fraction as obtained from a natural gas plant (for treating oil and gas) has an octane number of 84, which is well blended with the additives to prepare a fuel composition comprising:

| | | |
|---|---|---|
| a. | Pentane fraction | 100 parts (weight); |
| b. | Methyl tert-butyl ether | 3.6 parts |
| 4. | Quaternary ammonium salt of perfluoro alkylamide having formula of: $C_7F_{15}CONH(CH_2)_3N^+(CH_3)_3I^-$ | 0.003 parts |
| c. | Non-ionic fluorocarbon surfactant of fluorine-containing alkylether alcohol having formula of: $C_8F_{17}C_2H_4O[CH_2CH(CH_2OH)O]nH$ (n = 1.7) | 0.005 parts |

The fuel thus obtained has an octane number (RON) of 93, which has been increased from the original pentane fraction having RON of 84.

The above-mentioned quaternary ammonium salt (item c) may also be substituted with other cation surfactants, not limited in this invention.

EXAMPLE 3

Example 1 is repeated except that the methyl tert-butyl ether (6 parts) is substituted with tert-amyl methyl ether (6.6 parts). The fuel composition has an octane number (RON) of 93 which is increased from original pentane fraction having RON of 78.

EXAMPLE 4

Example 2 is repeated, except that the methyl tert-butyl ether (3.6 parts) has been substituted with tert-amyl methyl ether (4 parts), to thereby obtain a fuel composition having octane number of 93 which is increased from the original value of 84.

EXAMPLE 5

Example 1 is repeated, except that the methyl tert-butyl ether (6 parts) has been replaced by anhydrous methanol (7.5 parts) to obtain a fuel composition having an octane number (RON) of 93.

The above-mentioned anhydrous methanol may also be substituted with anhydrous ethanol.

In the present invention, the additives such as the cation surfactants, the non-ionic surfactants, and the anti-knocking agents may be optionally varied to obtain a desired fuel composition, depending upon the desired properties of the final fuel product, the selection of raw materials and the cost consideration.

According to the present invention, a motor fuel composition may be obtained having the following advantages superior to the prior art:

1. The pentane fraction is obtained as a recycling by-product from an oil refinery or a natural gas plant for saving cost for obtaining an energy resource.
2. The additives of non-lead anti-knocking agent and the surfactants will increase the octane number for enhancing anti-knocking property and also for enhancing a complete combustion of the fuel for minimizing carbon deposit or accumulation in the combustion and exhaust system for increasing the fuel and engine (or machine) efficiency and for prolonging service life of the engine (or machine).

The present invention may be modified without departing from the spirit and scope of the present invention.

Other light or low-carbon hydrocarbons may also be provided in this invention to be blended with the related additives for preparing a vehicle fuel composition having high octane number and minimum carbon deposit in the combustion and exhaust systems.

I claim:

1. A vehicle fuel composition comprising:

a. light or low-carbon hydrocarbon including pentane fraction . . . 100 parts (by weight);

b. non-lead anti-knocking agent . . . 1~15 parts (by weight) based on 100 parts (by weight) of the light hydrocarbon; and c. fluorocarbon cation surfactant . . . 0.01 parts (by weight) based on 100 parts (by weight) of the light hydrocarbon;

wherein said non-lead anti-knocking agent is selected from the group consisting of methyl tert-butyl ether, tert-amyl methyl ether, anhydrous methanol, and anhydrous ethanol; and wherein said fluorocarbon cation surfactant is a fluoroalkyl amine salt having a formula of: $[F(CF_2)_3CH(OH)CH_2]_2N\ CH_2CH_2NH_2.H_2SO_4$.

2. A vehicle fuel composition comprising:

a. light or low-carbon hydrocarbon including pentane fraction . . . 100 parts (by weight);

b. non-lead anti-knocking agent . . . 1~15 parts (by weight) based on 100 parts (by weight) of the light hydrocarbon;

c. fluorocarbon cation surfactant . . . 0.01 parts (by weight) based on 100 parts (by weight) of the light hydrocarbon; and d. non-ionic fluorocarbon surfactant of fluorine-containing alkylether alcohol . . . 0.005 parts (by weight) based on 100 parts (by weight) of the light hydrocarbon;

wherein said non-lead anti-knocking agent is selected from the group consisting of methyl tert-butyl ether, tert-amyl methyl ether, anhydrous methanol, and anhydrous ethanol;

wherein said fluorocarbon cation surfactant is a fluoroalkyl amine salt having a formula of: $[F(CF_2)_3CH(OH)CH_2]_2N\ CH_2CH_2NH_2.H_2SO_4$; and wherein said non-ionic fluorocarbon surfactant of fluorine-containing alkylether alcohol is selected from the group consisting of an alkylether alcohol having a formula of: $C_8F_{17}C_2H_4O\ [CH_2CH(CH_2OH)O]nH$ (n=1.7), and an alkylether alcohol having a formula of: $C_8F_{17}C_2H_4SO_2NH[CH_2CH(CH_2OH)O]nH$ (n=1.7).

* * * * *